US006231373B1

(12) United States Patent
Daoud

(10) Patent No.: US 6,231,373 B1
(45) Date of Patent: May 15, 2001

(54) CONNECTOR WITH INTEGRATED LIVING HINGE AND RESETTABLE SPRING

(75) Inventor: Bassel H. Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/218,062

(22) Filed: Dec. 21, 1998

(51) Int. Cl.[7] ..... H01R 4/24

(52) U.S. Cl. ..... 439/409; 439/352; 439/409; 439/387

(58) Field of Search ..... 439/387, 388, 439/389, 404, 409, 410, 417, 148, 350, 351, 352, 353, 354, 355, 356, 357, 358, 595, 596

(56) References Cited

U.S. PATENT DOCUMENTS

| | | | | |
|---|---|---|---|---|
| 3,611,264 | | 10/1971 | Ellis . | |
| 4,662,699 | | 5/1987 | Vachhani et al. . | |
| 4,793,823 | | 12/1988 | Cozzens et al. . | |
| 4,961,711 | * | 10/1990 | Fujiura et al. | 439/357 |
| 5,240,432 | | 8/1993 | Daoud . | |
| 5,637,011 | | 6/1997 | Meyerhoefer et al. . | |
| 5,860,829 | | 1/1999 | Hower et al. . | |
| 5,947,761 | * | 9/1999 | Pepe | 439/409 |
| 5,964,614 | * | 10/1999 | Daoud | 439/417 |
| 5,971,795 | * | 10/1999 | Daoud et al. | 439/409 |
| 5,989,054 | * | 11/1999 | Fasce | 439/409 |
| 5,993,264 | * | 11/1999 | Daoud | 439/676 |

* cited by examiner

*Primary Examiner*—Paula Bradley
*Assistant Examiner*—Truc Nguyen
(74) *Attorney, Agent, or Firm*—Stroock & Stroock & Lavan LLP

(57) ABSTRACT

A latching mechanism for an insulation displacement connector comprises a cap section, a base section, a latch member and a biasing member preferably configured as a type of spring. The cap section is movable between an open position and a closed position and includes a finger-grip member. The base section is connected to the cap section and includes a latch retaining portion. The latch member contains a latch-engaging portion, a living hinge and a latch base. The latch member is movable between an engaged position and disengaged position. The latch member maintains the cap section in the closed position when the latch member is in the engaged position and the latch engaging portion is confrontingly engaged with the latch retaining portion in this closed position. The biasing member may be formed as an elastically deformable member that has a bend point and is connected to the cap section proximate the finger grip member. Additionally, the biasing member is connected to the latch member at the latch base. The biasing member is forced to bend at the bend point by the latch member when the latch member pivots about the living hinge as it is moved to the disengaged position. This tensions the biasing member causing it to exert an opposing force on the latch member, biasing it so that it tends to return it to the engaged position.

23 Claims, 6 Drawing Sheets

CONNECTOR WITH INTEGRATED LIVING HINGE AND RESETTABLE SPRING

FIELD OF THE INVENTION

This invention relates generally to the field of telephone wire connectors and distribution systems, and specifically to a integrated living hinge and resettable spring for an insulation displacement connector (IDC).

BACKGROUND OF INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit (NIU). Within such devices the individual telephone line tip ring pairs are separated from the cable, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that the subscriber can isolate troubles on the line as originating in the telephone network, or on the terminal equipment side of the telephone line.

Additionally, there are known insulation displacement connector (IDC) blocks for use in such junction boxes and/or distribution fields, such as the ubiquitous punch down connector block, also known as a 66-type connector block, and the tool-less insulation displacement connector blocks utilizing push cap connectors, such as that described in U.S. Pat. No. 4,913,659 dated Apr. 3, 1990, the entire disclosure of which is incorporated herein by reference. Such a connector block is commercially available under the product designation SC99 from Lucent Technologies Inc. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971. Also widely available are tool-less IDC's known as Mini-Rocker Connectors such as those sold by A. C. Egerton Ltd., which hold a tip-ring wire pair in terminals retained under a signal movable cap through which both wires of the pair are inserted.

The cap section and base section of mini-rocker tool-less IDC connectors are held together by a latching mechanism known in the art. In order to achieve good latching performance, a significant amount of movement and deflection of the latch is required. This movement is facilitated by a living hinge. While this prior art IDC works for its intended purpose, a significant drawback to this prior art IDC is that with the passage of time and the effects of changes in temperature and pressure, the living hinges tend to lose their elastic properties. Thus, connectors with these prior art latches have to be manually hooked into position by the installer. This makes the latching mechanism unreliable because the installer may forget to complete the manual hook-up of the latch, causing early and unwanted disengagement of the cap from the base, permitting installed wires to disconnect.

SUMMARY OF THE INVENTION

The present invention is directed at overcoming shortcomings in the prior art. Generally speaking, in accordance with the present invention, a latching mechanism for an insulation displacement connector comprises a cap section, a base section, a latch member and a biasing member preferably configured as a type of spring. The cap section is movable between an open position and a closed position and includes a finger-grip member. The base section is connected to the cap section and includes a latch retaining portion. The latch member contains a latch-engaging portion, a living hinge and a latch base. The latch member is movable between an engaged position and disengaged position. The latch member maintains the cap section in the closed position when the latch member is in the engaged position and the latch engaging portion is confrontingly engaged with the latch retaining portion in this closed position. The biasing member may be formed as an elastically deformable member that has a bend point and is connected to the cap section proximate the finger grip member. Additionally, the biasing member is connected to the latch member at the latch base. The biasing member is forced to bend at the bend point by the latch member when the latch member pivots about the living hinge as it is moved to the disengaged position. This tensions the biasing member causing it to exert an opposing force on the latch member, biasing it so that it tends to return it to the engaged position.

In an alternate embodiment, the latching mechanism is biased by a deflection beam. The deflection beam has a beam free end and a beam attached end whereby the beam is connected to the cap section at the beam attached end and the beam is in sliding, biasing contact with the latch base of the latch member at the beam free end. The free end is forced to bend by the latch member when the latch member pivots about the living hinge in the disengaged position, such that the beam exerts a biasing force on the latch member tending to return the latch member to the engaged position.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
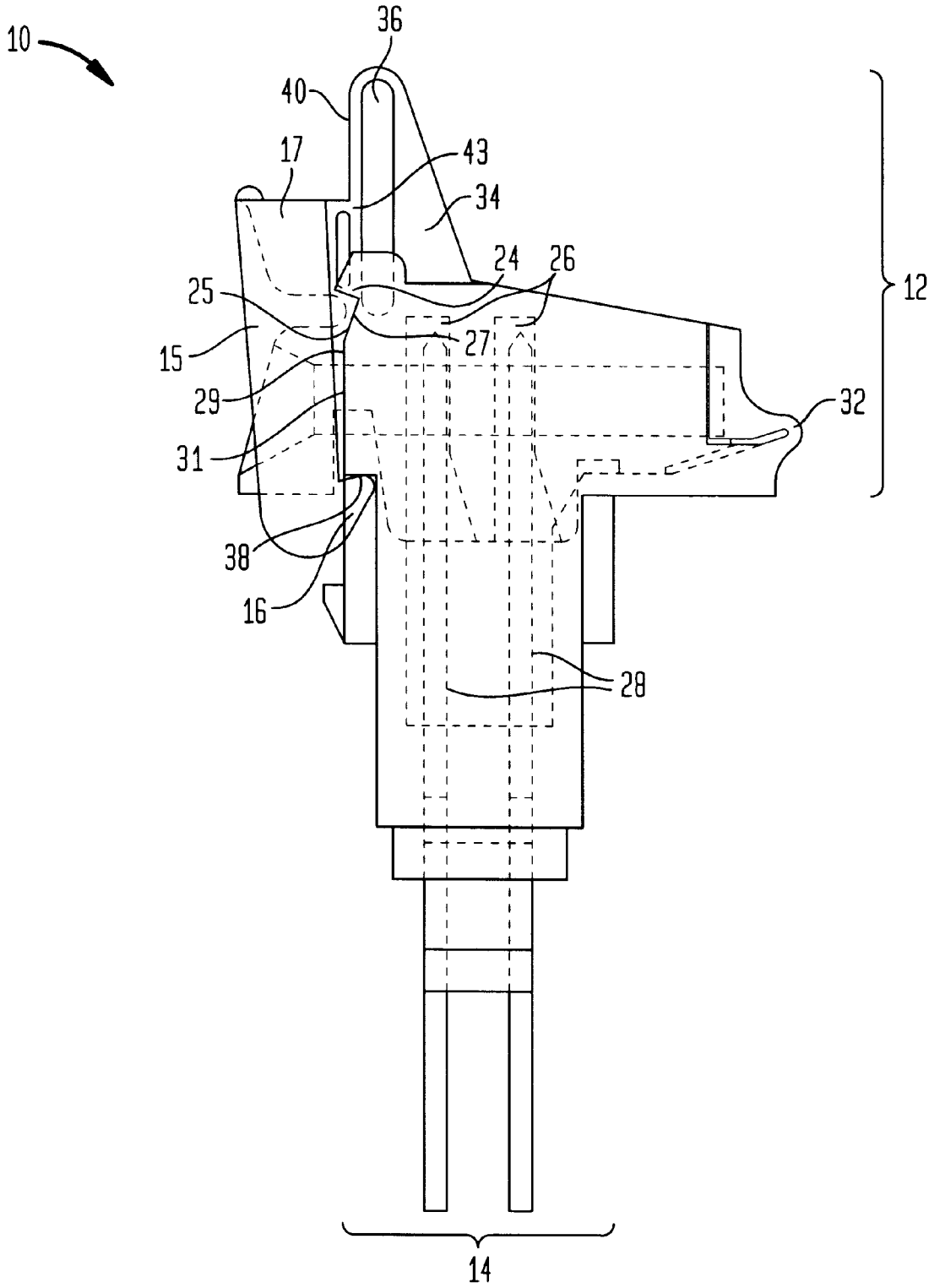
FIG. 1 is a side elevational view of a connector constructed in accordance with a preferred embodiment of the present invention with the cap section in the closed position.
Figure 2:
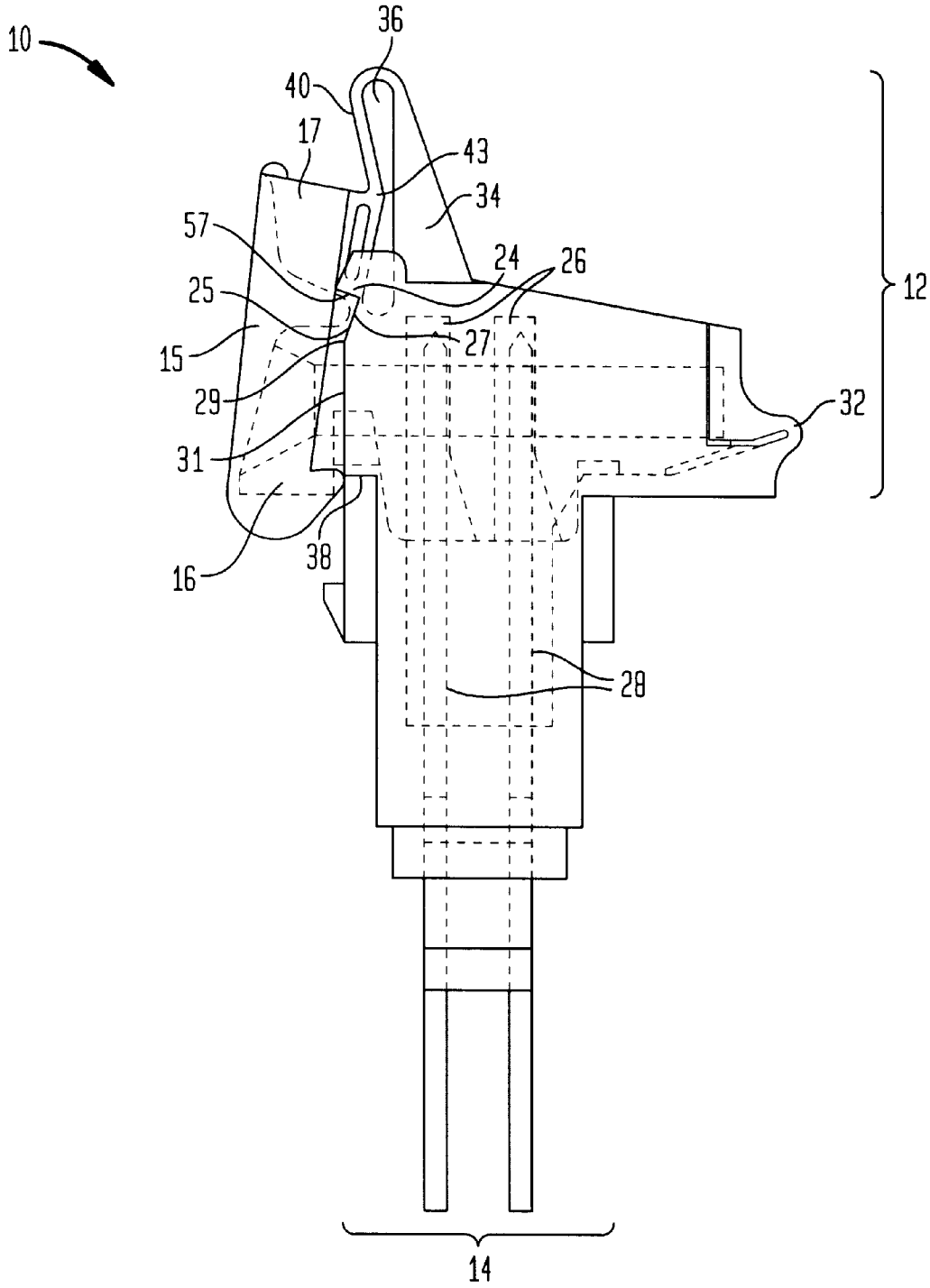
FIG. 2 is a side elevational view of the connector of FIG. 1 with the cap section in the unlatched position.
Figure 3:
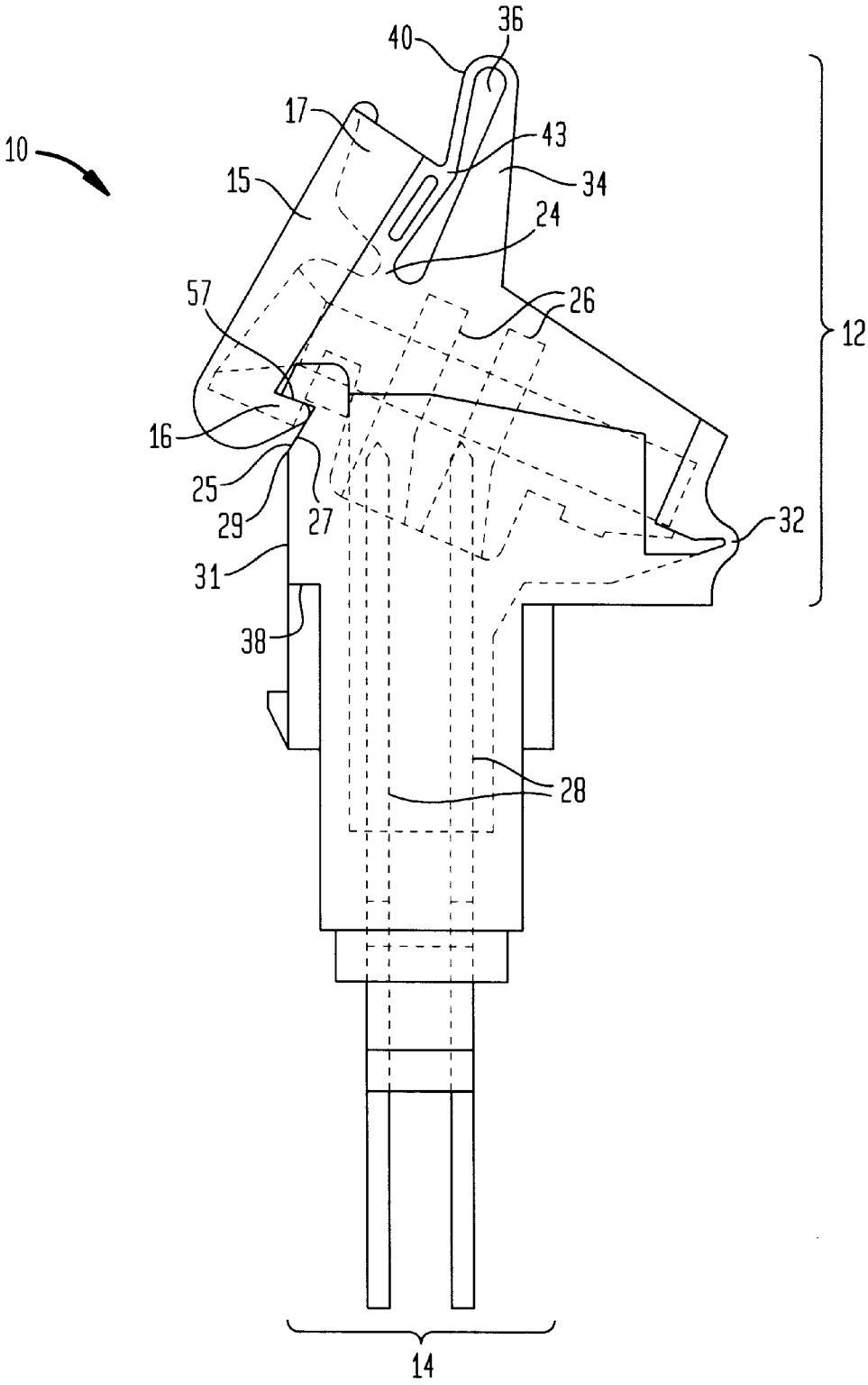
FIG. 3 is a side elevational view of the connector of FIG. 1 with the cap section in the open position.

Reference is first made to FIGS. 1–3, which illustrate an insulation displacement connector of the present invention generally indicated as 10. Connector 10 has a cap section, generally indicated as 12, and a base section, generally indicated as 14. Cap section 12 is hingeably connected to base section 14 at a hinged pivot point 32. Cap section 12 pivots about pivot point 32 and is movable between an open position, as illustrated in FIG. 3, and a closed position, as illustrated in FIGS. 1 and 2. Base section 14 is fixed and generally includes at least one terminal strip 28 of an art recognized type.

Cap section 12 includes a latch 15 which is movable between an engaged position, as illustrated in FIG. 1, and a disengaged position, as illustrated in FIGS. 2–3. Latch 15 includes a latch engaging portion 16. Base section 14 includes a latch retaining portion 38. When cap section 12 is in the closed position, latch 15 is in the engaged position. In this orientation, latch engaging portion 16, confrontingly abuts and engages latch retaining portion 38, thereby maintaining cap section 12 in the closed position. In order to open cap section 12, latch 15 must first be moved to the disengaged position, as illustrated in FIG. 2.

Latch 15 also includes a latch base 17 which is connected to a spring 40 at a bend point 43. Spring 40 is also connected to cap section 12 through a finger grip member 34. In a preferred embodiment, spring 40 is an elastically deformable biasing member integrally formed in said cap and defining an elongated opening or aperture 36 that is shaped as an elongated ovoid which may have parallel sides, as shown. Aperture 36 can be a variety of shapes and sizes as a matter of application specific design choice.

In the closed position, as illustrated in FIG. 1, when latch 15 is in the engaged position, spring 40 is relaxed and there is no tension at bend point 43. Movement of latch 15 between the engaged and disengaged positions can be accomplished by gripping connector 10 between latch 15 and finger grip member 34. Upon the application of pressure, spring 40 bends at bend point 43 into aperture 36 while latch 15 concurrently pivots about living hinge 24. By applying sufficient pressure such that latch 15 is pivoted about living hinge 24 by a sufficient distance, latch engaging portion 16 can be disengaged from latch retaining portion 38, as seen in FIG. 2, and cap section 12 can be moved into the disengaged position as illustrated in FIGS. 2 and 3.

Upon movement from the closed to open position, latch engaging portion 16 of latch 15 comes into contact with low interference region 31 which provides low interference to the motion of latch engaging portion 16 towards a high interference point 29. High interference point 29 provides the highest resistance to the movement of latch engaging portion 16. As seen in side view, high interference point 29 protrudes beyond low interference region 31 and low interference region 25. After moving past high interference point 29, latch engaging portion 16 comes into contact with an abutment wall 57 in notch 27. When latch engaging portion 16 is housed in notch 27, as illustrated in FIG. 3, cap section 12 is in the fully open position. In this position, notch 27 of base section 14 forces latch engaging portion 16 of latch 15 into the disengaged position. This force is transferred through latch 15 to spring 40 at bend point 43. Consequently, spring 40 is maintained in its bent or tensioned position as illustrated in FIGS. 2 and 3. The biasing force exerted by spring 40 which when unopposed would return spring 40 into its relaxed position is counter-balanced by the force exerted by abutment wall 57 of notch 27 of base section 14 on latch engaging portion 16, thus keeping spring 40 in tension.

Reference is again made to FIG. 3 which depicts connector 10 with cap section 12 in the fully open position. To achieve the closed position, as illustrated in FIG. 1, pressure is applied on latch 15 to move it in a downward direction towards base section 14, through low interference region 25 of notch 27, past high interference point 29 and low interference region 31 towards latch retaining portion 38. Once the latch engaging portion 16 of latch 15 is in a confronting orientation with latch retaining portion 38, as illustrated in FIG. 2, the biasing force applied by spring 40 on latch 15 causes latch engaging portion 16 to matingly engage latch retaining portion 38, as seen in FIG. 1. In this orientation, spring 40 is in its fully relaxed, or at least minimally tensioned position, as also illustrated in FIG. 1.

Base section 14 of connector 10 preferably includes at least one terminal strip 28. Generally, as known in the art, an insulation displacement connector can contain two terminal strips. Cap section 12 of connector 10 includes terminal strip receiving portions 26, which are constructed so as to be capable of receiving terminal strips 28 when cap section 12 is in the closed position, as illustrated in FIG. 1.

Figure 4:
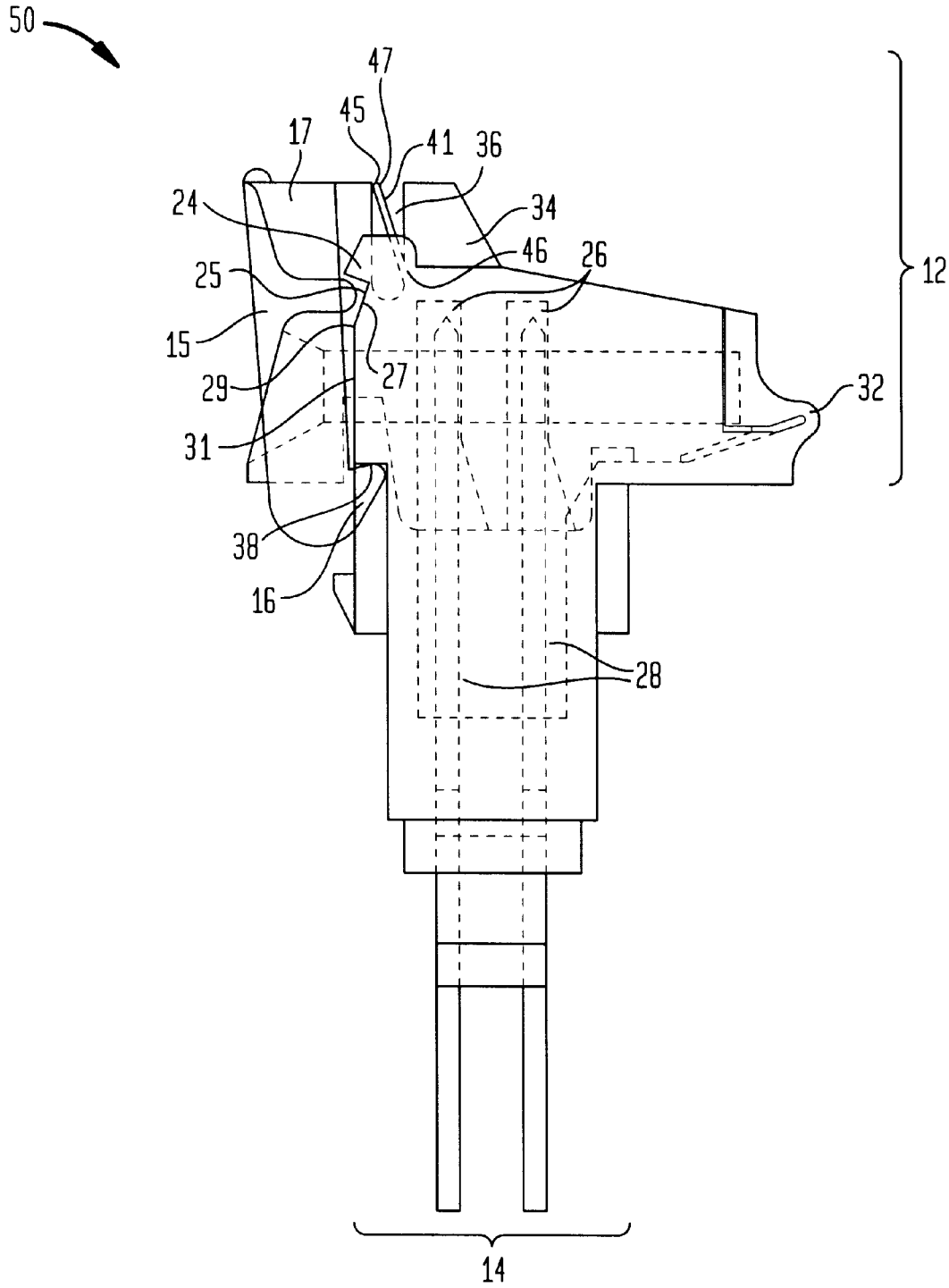
FIG. 4 is a side elevational view of a connector constructed in accordance with an alternate embodiment of the present invention with the cap section in the closed position.
Figure 5:
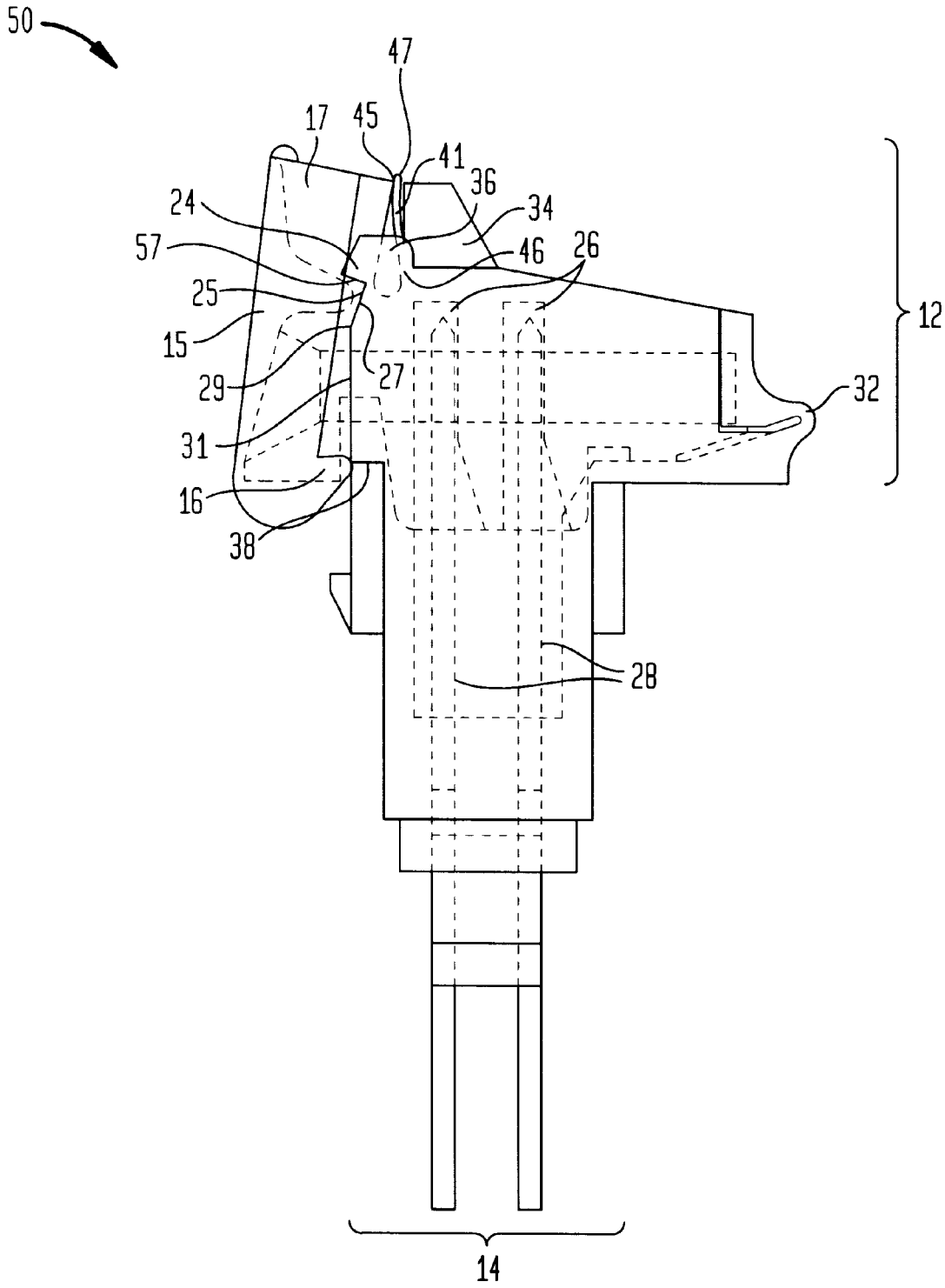
FIG. 5 is a side elevational view of the connector of FIG. 4 with the cap section in the unlatched position.
Figure 6:
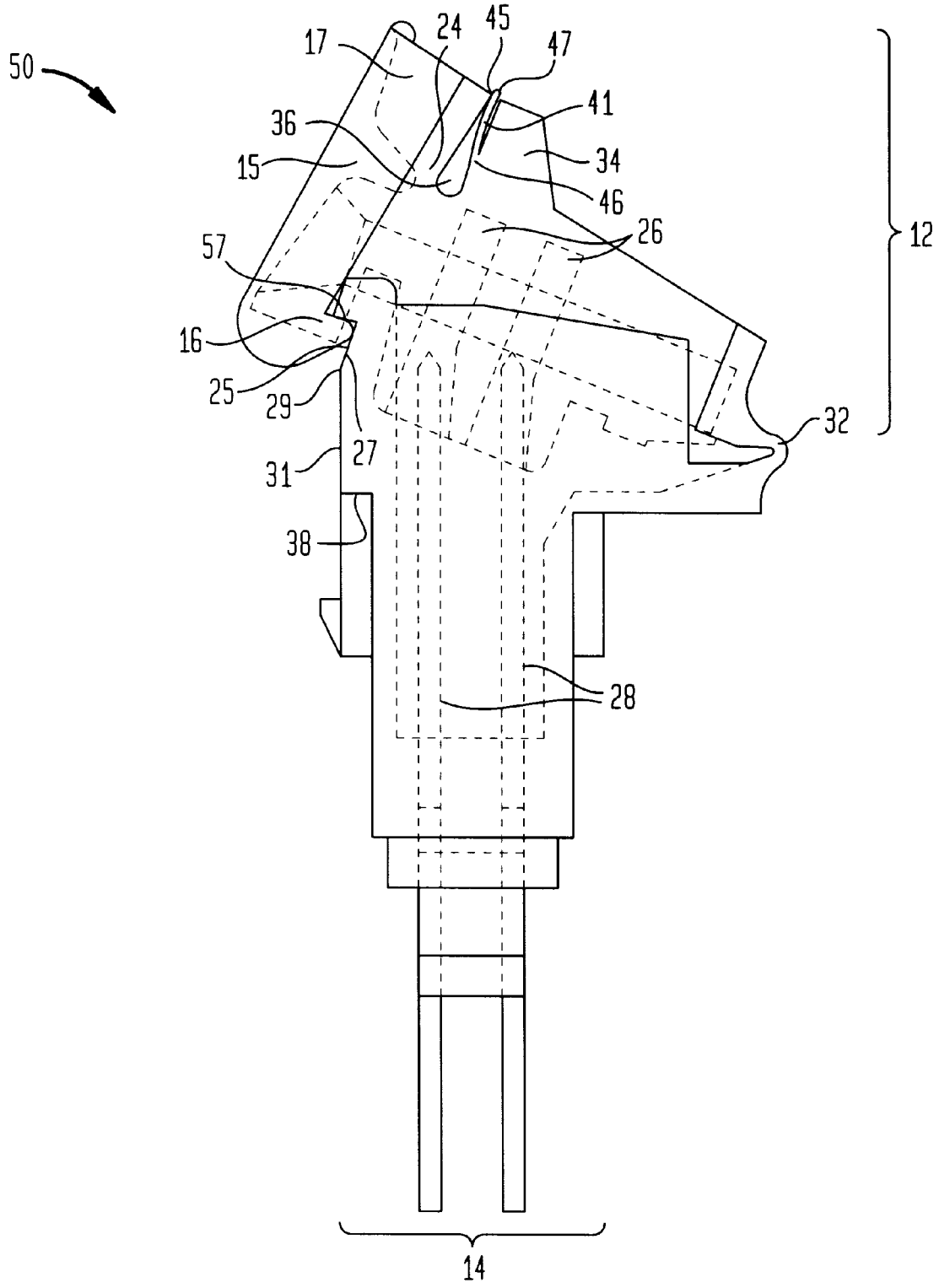
FIG. 6 is a side elevational view of the connector of FIG. 4 with the cap section in the open position.

Reference is now made to FIGS. 4–6 which illustrate another embodiment of an insulation displacement connector constructed in accordance with the present invention, generally indicated as 50. FIG. 4 illustrates cap section 12 of connector 50 in a closed position whereas FIG. 6 illustrates cap section 12 in the open position. This embodiment includes a deflection beam forming spring beam 41 which has a beam attached end 46 and a beam free end 47. Beam attached end 46 of beam 41 is affixed to finger grip member 34 whereas beam free end 47 is in slidable biasing contact with latch base 17 of latch 15 at a beam contact point 45, as illustrated in FIG. 4. Beam 41 may have one or more beam free ends 47 and beam 41 may be constructed in a variety of shapes and sizes as a matter of application specific design choice.

In use, to move latch 15 from its engaged position, as illustrated in FIG. 4, to its disengaged position, as illustrated in FIG. 6, pressure is applied by holding latch 15 and finger grip member 34 as discussed above. This causes beam 41 to be deflected due to the pressure exerted by latch base 17 at beam contact point 45 as latch 15 pivots about living hinge 24, as is illustrated in FIG. 5. Concurrently, latch engaging portion 16 of latch 15 is unlatched from latch retaining portion 38 of base section 14. Once latch engaging portion 16 is moved past low interference region 31 and high interference point 29 into low interference region 25, latch engaging portion 16 is housed within notch 27 of base section 14 as in the above-described embodiment of the present invention. Low interference region 31 and low interference region 25 provide minimal interference to the movement of latch 15 between its engaged position as illustrated in FIG. 4 and its disengaged position as illustrated in FIG. 6. On the other hand, high interference point 29 provides the highest amount of resistance to the movement of latch 15 between its engaged and disengaged positions. High interference point 29 protrudes out from low interference region 31 and low interference region 25. When latch 15 is in the open position, with latch engaging portion 16 housed in notch 27, spring beam 41 is in its fully deflected position as illustrated in FIG. 6. In this position, beam 41 exerts biasing force on latch 15 at beam contact point 45 with latch base 17 tending to push latch 15 towards its engaged position. However, notch 27 of base section 14 compensates for the force applied by beam 41 on latch 15 by opposing the biasing force on latch engaging portion 16 and thereby maintaining latch 15 in the disengaged position. To move latch 15 into the engaged position, latch 15 is gripped between latch base 17 and finger grip member 34 and pressure is applied to unlatch latch engaging portion 16 of latch 15 from notch 27 of base section 14 as illustrated in FIG. 5. Latch engaging portion 16 is then moved past high interference point 29 and towards latch engaging portion 38 of base section 14. Beam 41 continues biasing latch 15 at beam contact point 45, thus returning latch 15 to its engaged position. Once latch engaging portion 16 of latch 15 is in confronting orientation with latch retaining portion 38 of base section 14 as illustrated in FIG. 5, the biasing force by spring beam 41 on latch member 15 causes latch engaging portion 16 to matingly engage with latch retaining portion 38, thereby retaining latch 15 in the engaged position, as illustrated in FIG. 4.

Thus, spring 40 in the first embodiment and beam 41 in the second embodiment assist living hinge 24 in returning latch 15 into the engaged position. Consequently, even if living hinge 24 loses its elastic properties over time, connectors 10, 50 will not have to be manually latched by the installer, due to the operation of spring 40 and spring beam 41. This makes for a more reliable and efficient latching mechanism for an insulation displacement connector. Cap section 12, base section 14, latch 15, spring 40 and spring beam 41 may be formed of any art recognized material having the proper insulating and mechanical properties. Preferably, plastic is employed. Further, spring 40 and beam 41 may be made of any art recognized size, shape and material that has the appropriate mechanical and elastic properties to achieve the solutions taught herein, such as, for example, coil springs, torsion rods, bladders, and the like. Further, the connector of the present invention may be used, alone or as one of an array of connectors on a connector block, in a wiring enclosure, such as, for example, a Building Entrance Protector (BEP) or Network Interface Unit (NIU).

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A latching mechanism for an insulation displacement connector comprising:

a cap section being movable between an open position and a closed position;

a base section hingedly connected to said cap section, said base section including a latch retaining portion;

a latch member having a latch engaging portion, a living hinge and a latch base, said latch member being movable between an engaged position and a disengaged position, said latch member maintaining said cap section in said closed position when said latch member is in said engaged position, said latch engaging portion confrontingly engaging said latch retaining portion in said closed position; and a biasing member connected to said cap section and in contact with said latch member, said biasing member being tensioned by said latch member when said latch member pivots about said living hinge into said disengaged position such that said biasing member biases said latch member to return to said engaged position said biasing member defining in part an opening when said latch is in said engaged position, said latch base occupying a portion of said space when said latch is in said disengaged position.

2. The latching mechanism of claim 1, wherein said cap section includes a finger grip member.

3. The latching mechanism of claim 1, wherein said base section is connected to said cap section at a pivot point.

4. The latching mechanism of claim 1, wherein said base section includes a notch, said notch having a high interference point, a low interference region and an abutment wall.

5. The latching mechanism of claim 4, wherein said latch member maintains said cap section in said open position when said latch member is in said disengaged position, said notch maintaining said latch member in said disengaged position by counter-balancing the biasing of said latch member by said biasing member.

6. The latching mechanism of claim 2, wherein said biasing member is connected to said cap section proximate said finger grip member.

7. The latching mechanism of claim 1, wherein said biasing member is in contact with said latch member at said latch base.

8. The latching mechanism of claim 1, wherein said biasing member defines an aperture that is oval shaped.

9. The latching mechanism of claim 1, wherein said cap section comprises one or more terminal strip receiving portions.

10. The latching mechanism of claim 1, wherein said base section comprises one or more terminal strips.

11. The latching mechanism of claim 1, wherein said biasing member is a deflection beam.

12. The latching mechanism of claim 11, wherein said beam has a beam free end and a beam attached end, said beam being connected to said cap section proximate said beam attached end.

13. The latching mechanism of claim 12, wherein said beam free end is in contact with said latch member at said latch base.

14. The latching mechanism of claim 11, wherein said beam has a plurality of beam free ends.

15. The latching mechanism of claim 11, wherein said cap section comprises one or more terminal strip receiving portions.

16. The latching mechanism of claim 11, wherein said base section comprises one or more terminal strips.

17. The latching mechanism of claim 1, wherein said insulation displacement connector is disposed on a connector block.

18. The latching mechanism of claim 1, wherein said insulation displacement connector is disposed in a wiring enclosure.

19. The latching mechanism of claim 8, wherein said insulation displacement connector is disposed on a connector block.

20. The latching mechanism of claim 8, wherein said insulation displacement connector is disposed in a wiring enclosure.

21. The latching mechanism of claim 11, wherein said insulation displacement connector is disposed on a connector block.

22. The latching mechanism of claim 11, wherein said insulation displacement connector is disposed in a wiring enclosure.

23. An insulation displacement connector comprising:

a cap moveable between an open position and a closed position;

a latch, said latch having a latch base, mounted on said cap and movable via a hinge between an engaged position and a disengaged position; and a biasing member in contact with said latch and biasing said latch into said engaged position a biasing member defining in part an opening when said latch is in said engaged position, said latch base occupying a portion of said opening when said latch is in said disengaged position.

* * * * *